US012312927B1

(12) United States Patent
Wang et al.

(10) Patent No.: US 12,312,927 B1
(45) Date of Patent: May 27, 2025

(54) FRACKING EFFICIENCY EVALUATION SYSTEM AND METHOD(S) OF USE

(71) Applicant: IFDATA LLC, Houston, TX (US)

(72) Inventors: Wen Wang, Houston, TX (US); Joseph Mjehovich, Denver, CO (US); Ge Jin, Houston, TX (US)

( * ) Notice: Subject to any disclaimer, the term of this patent is extended or adjusted under 35 U.S.C. 154(b) by 5 days.

(21) Appl. No.: 18/408,057

(22) Filed: Jan. 9, 2024

(51) Int. Cl.

| | |
|---|---|
| ***E21B 43/26*** | (2006.01) |
| ***E21B 47/06*** | (2012.01) |
| ***E21B 47/08*** | (2012.01) |
| ***E21B 49/00*** | (2006.01) |

(52) U.S. Cl.
CPC ..... *E21B 43/26* (2013.01); *E21B 49/006* (2013.01); *E21B 47/06* (2013.01); *E21B 47/08* (2013.01); *E21B 2200/20* (2020.05)

(58) Field of Classification Search
CPC ..... E21B 43/26; E21B 49/00; E21B 2200/20; E21B 49/006; E21B 47/06; E21B 47/08
See application file for complete search history.

(56) References Cited

U.S. PATENT DOCUMENTS 11,286,773 B2 * 3/2022 Jin ..... E21B 47/06
2023/0009947 A1 * 1/2023 Ruhle ..... E21B 47/06

FOREIGN PATENT DOCUMENTS

CA 3150258 C * 9/2023 ..... E21B 41/0092

OTHER PUBLICATIONS

English translation of CN 116882118. (Year: 2023).*

* cited by examiner

*Primary Examiner* — Zakiya W Bates
(74) *Attorney, Agent, or Firm* — Leyendecker & Lemire, LLC

(57) ABSTRACT

A fracking efficiency evaluation system and method of use of the system can be implemented to generate a completion design plan based on quantitative analysis of fracture widths. The fracture widths can be implemented to create a frac unevenness parameter, a fracture surface area parameter, and a leakage volume estimation parameter. One or more of the parameters can be used to generate the completion design plan for optimizing performance of a treatment well.

20 Claims, 3 Drawing Sheets

FRACKING EFFICIENCY EVALUATION SYSTEM AND METHOD(S) OF USE

BACKGROUND

The implementation of effective completion design configurations during hydraulic fracturing stimulation is crucial for the economic development of unconventional wells. The most successful completion design programs prioritize strategic well placement and optimize design parameters to assert control on fluid and proppant delivery, enabling uniform fracture placement and ultimate resource access. However, understanding the key drivers behind the artificially induced fracture network remains a challenge due to the interdependence of subsurface complexities, completion design variations, and well engineering. Considering that well completion is often the most prohibitive cost to operators, the continued development of advanced monitoring techniques remains a priority.

Distributed fiber-optic sensing (DFOS) is a class of sensing techniques that has become available within the last decade for monitoring the completion and production of unconventional wells. DFOS effectively turns a length of fiber-optic cable into a linear network of sensors that are sensitive to mechanical strain, vibration, and temperature variations along the length of a wellbore.

Fiber-optic cables installed in an offset monitoring well can enable the acquisition of distributed strain measurements associated with the propagation of hydraulic fractures imparted by a nearby injection well. Distributed strain sensing (e.g., low-frequency distributed acoustic sensing, or LF-DAS) based cross-well monitoring provides critical information constraining key principles on fracture density, height, length, and orientation. However, many of the field-based LF-DAS applications have been restricted to qualitative analysis, limiting the use of cross-well strain measurements for hydraulic fracturing diagnostics.

Cross-well based distributed strain measurements have more potential to characterize fracture geometry quantitatively. Recent studies have successfully employed a geomechanical inversion algorithm to calculate fracture width, facilitating a more detailed estimation of overall fracture geometry. Despite these advancements, a method for interpretation that relates fracture geometry to hydraulic fracturing efficiency is not well understood and has not yet been developed. To enhance the effectiveness of distributed cross-well strain measurements, it is critical to develop more rigorous, quantitative analysis and interpretation techniques. This shift is crucial for advancing the technology beyond the current constraints of qualitative analysis, creating a more comprehensive diagnostic tool for evaluating hydraulic fracturing designs.

DETAILED DESCRIPTION

Figure 1A:
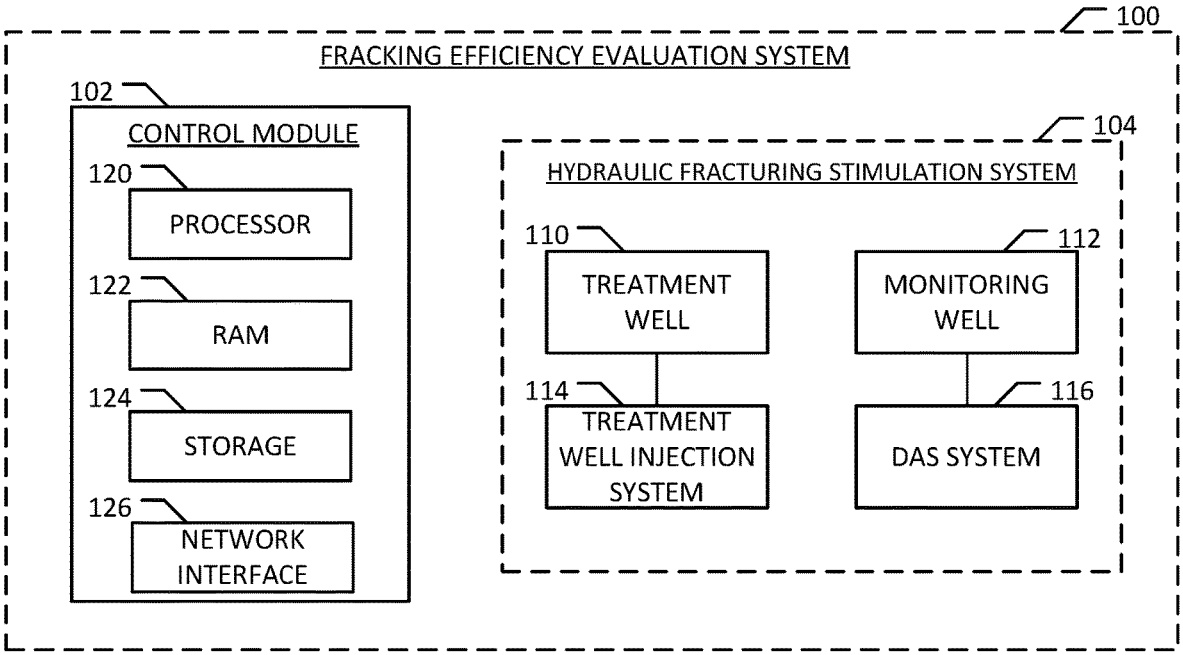
FIG. 1A is a block diagram of a fracking efficiency evaluation system according to one embodiment of the present invention.

Embodiments of the present invention include a fracking efficiency evaluation system and method(s) of use thereof. The fracking efficiency evaluation system can implement one or more unique parameters for evaluating each stage of a treatment well. The unique parameters can implement fracture widths calculated from distributed strain data generated by a monitoring well close to a treatment well. Based on the fracture widths, one or more parameters can be calculated to aid in creating a completion design plan. Typically, a frac unevenness parameter, a fracture surface area parameter, and a leakage volume estimation parameter can be generated from the fracture widths. Each stage of the treatment well may be evaluated using at least one of the parameters.

The fracking efficiency evaluation system can include, but is not limited to, a control module, a treatment well, and a monitoring well. The monitoring well can be configured to detect fractures created during the treatment of the treatment well. Data from the monitoring well related to fractures can be provided to the control module. The control module can be configured to analyze the data by applying one or more of the previously mentioned parameters.

Embodiments of the present invention can implement a geomechanical inversion algorithm to calculate dynamic fracture widths using distributed strain data recorded at one or more monitoring wells. For example, low-frequency distributed acoustic sensing (LF-DAS) data recorded at one or more monitoring wells with permanent optical fiber installations can be analyzed. It is to be appreciated that the monitoring wells may implement permanent or temporary fiber-optic installations. Typically, an algorithm can implement the displacement discontinuity method (DDM) to construct geomechanical models inverting linear elastic strain to hydraulic fracture widths. The inverted fracture widths at the monitoring wells can be implemented to diagnose an efficiency of a completion design plan to be implemented in a treatment well. One or more metrics can be determined to evaluate completion design efficiency including, but not limited to, unevenness of fracture widths, fracture density (e.g., number of fracture hits per foot), and fracture-width-density (e.g., fracture width/stage length) at the monitoring wells.

Fiber-optic cables installed in an offset monitoring well can enable an acquisition of distributed strain measurements associated with the propagation of hydraulic fractures imparted by a nearby injection well. Distributed strain sensing based cross-well monitoring can provide critical information constraining key principles on fracture density, height, length, and orientation. One of the most prevalent technologies currently employed for gathering distributed strain data is low-frequency acoustic sensing (LF-DAS). However, currently available LF-DAS applications have been limited to mostly qualitative interpretations for hydraulic fracturing diagnostics.

In one example, the geomechanical algorithm can be implemented for the inversion of hydraulic fracture widths using cross-well distributed strain measurements. The calculated fracture widths at the monitoring well may then serve as a metric to qualify and quantify a performance and efficiency of a unique completion design. The specialized fiber-optic surveillance program can enable a continuous monitoring of multi-cluster hydraulic fracturing stages in a treatment well. Typically, cross-well analysis has been primarily used for qualitative interpretations to describe the hydraulic fracturing network.

The design parameters of a hydraulic fracturing operation can significantly impact efficiency and overall success of a treatment well. Variations in clusters spacing, tapered perforations, stage length, limited entry and other design aspects can play pivotal roles in shaping the economic development of a fracking operation. Notably, the implementation of more efficient designs often come with an associated increase in the cost per stage required for well completion. Furthermore, reservoir conditions, such as reservoir geological heterogeneity or the impact of depletion effects associated with nearby parent wells, should also be contemplated and included when determining a completion design efficiency and formulating a completion design strategy. Accordingly, the development of more sophisticated monitoring and analysis techniques are critical for providing operators with an additional level of quantitative information, facilitating the optimization of hydraulic fracturing treatments and reducing costs associated with the development of unconventional wells.

Embodiments of the present invention can be implemented to quantitatively evaluate hydraulic fracturing completion designs using distributed strain measurements. One or more novel parameters can be defined for the adopted geomechanical algorithm and parameters required for fracture width inversion. The described methodology can identify qualitative and quantitative features to diagnose an effectiveness of various completion designs and present a plan for moving forward. In some instances, interpretations of distributed strain measurements can be cross validated using other monitoring techniques, such as in-well DAS measurements. The evaluation of design performance via cross-well distributed strain measurements typically yields qualitative insights, often reliant on the timing and location of fracture hits. Integrating fracture width calculations provides an advanced level of quantitative information of the fracture geometry, facilitating a more comprehensive and reliable cross-well interpretation.

Design performance evaluation via cross-well distributed strain measurement can include the collaborative interpretation of qualitative (e.g., frac density, frac hit time, etc.) and quantitative (e.g., fracture width, width density, etc.) features. For example, width density, derived by normalizing the cumulative maximum fracture width per stage by the stage length, offers critical information on fracture width distribution along the wellbore. Frac density, calculated as the number of frac hits per stage normalized by the stage length, measures the efficiency and effectiveness of the stimulation process to generate fractures within the reservoir.

Examining both qualitative and quantitative features is critical in understanding the impact of different treatment designs on fracture development. For instance, two stages with different completion designs may yield identical qualitative frac density results, suggesting similar performance by qualitative analysis only. However, variations in quantitative width density between these stages allow for a more comprehensive assessment, indicating differences in their respective design performance.

Frac density and width density can provide critical information for stage level interpretations. For example, a large increase in width density can occur with little variation in frac density. Large increases in width density with relatively little or no variation in frac density indicate an increase in average fracture width for the fractures reaching the monitor well. This may possibly be associated with uneven fluid and proppant distribution in the treatment well, leading to only a few "super fractures" intaking most the of fracking fluid, resulting in fewer, but wider fractures at the monitoring well and reduced surface area contact with the reservoir.

Additional quantitative analysis of the time-dependent fracture widths also provides insight into the transient behavior of fracture development throughout the duration of the treatment stage. For instance, one observation might be that an initial fracture opens until another fracture intercepts the monitor well. Subsequently, the first fracture may begin to close while the second fracture continues to grow. This characterization of dynamic interactions among fractures over time enhances our comprehension of the effects of completion design strategies such as diversion techniques and variable fracking fluid and proppant concentrations during a treatment stage.

In general, an inversion algorithm can be implemented to calculate dynamic fracture widths using distributed strain data recorded at a monitoring well (or wells). Described hereinafter is one example implementation of the inversion algorithm for LF-DAS based cross-well strain data. It is to be appreciated that other inversion algorithms may be implemented depending on how the distributed strain data may be collected. In a cartesian coordinate system, a fracture-fiber system can be discretized into "M" sensing points along a monitoring well and the fracture can be divided into "N" elements. A three-dimensional displacement discontinuity method can be used to construct a forward model relating cross-well strain data to fracture width and height. A strain recorded at sensing point "$M_a$" at the monitoring well can be the superposition of strain contributions associated with each fracture element under an assumption of linear elastic rock deformations. Regularized linear least-squares inversion can be applied to solve a system of equations for time evolving fracture widths at the monitoring well location.

Prior to inversion, the LF-DAS data can be converted from optical phase change rate to strain rate:

$$\dot{\varepsilon} = \frac{\lambda}{4\pi n' \zeta L} \Delta\dot{\phi}$$

Where n'=1.5 is the refractive index, dimensionless; $\zeta$=0.8 is a multiplicative constant accounting for photoelastic effect, dimensionless; L=7 m is the gauge length; and $\lambda$=1550 nm is the probe laser wavelength. Of note, these values may be specific to a particular DAS acquisition system. It is to be appreciated that some systems may have different values based on the technology/equipment vendor/acquisition parameters etc.

To help aid in creating a well completion plan, a fracture unevenness (or frac unevenness or Frac UE) parameter can be implemented to quantify a uniformity of fracture widths within a fracturing stage. The fracture unevenness parameter can use time-dependent fracture width data generated by inversion software to generate a single value that can characterize a degree of uniformity in fracture growth. In general, a lower fracture unevenness score may indicate more even fracture growth, aligning with an efficient fracking design. Based on a relative spacing between perforation clusters in the treatment well and individual fractures at the monitoring well, fracture-cluster pairs can be assigned. To diagnose and "score" fracking stages using the time-evolving fracture widths, the fracture unevenness parameter can be defined as:

$$Frac\ UE = 100 * \left( \frac{\sqrt{\frac{\sum_{i=1}^{n} (x_i - \bar{x})^2}{n-1}}}{\frac{\sum_{i=1}^{n} x_i}{n}} \right)$$

Where "$x_i$" is the maximum fracture width associated with each fracture-cluster pair, "$\bar{x}$" is the mean fracture width for the stage, and "n" is the number of clusters in the stage. If a cluster does not result in an identified fracture hit at the monitoring well, that fracture may be assigned a width value of zero. With this formulation, Frac UE is sensitive to the number of fractures compared to the number of clusters in a stage (e.g., frac efficiency), and the uniformity of the maximum width value for all fractures. Of significant note, a higher Frac UE value can indicate more unevenness in fracture growth for the same stage. Lower Frac UE scores can be associated with optimal frac efficiency (i.e., number of fractures compared to number of clusters), and more uniform fracture widths measured at the monitoring well. Higher Frac UE scores can represent less favorable design performance.

In instances where a Frac UE parameter may not be applicable for a stage, a ratio of actual frac surface area to optimum frac surface area may be implemented to create a fracture surface area parameter. The fracture surface area parameter can be a ratio between an actual frac surface area and an optimum frac surface area. More specifically, a ratio can be calculated of actual frac surface area to optimum frac surface area to generate a percentage value that can be used for design optimization decisions in the completion design plan. The optimum frac surface area can assume a fracture geometry and that all clusters at the treatment well initiate a fracture that grows within the assumed fracture geometry. The fracture geometry parameters can be constrained by quantitatively inverted fracture widths at the monitoring well, spacing between treatment and monitoring wells, and injected treatment fluid volume. The fracture geometry parameters can include, but are not limited to, fracture width, length, and height. The actual frac surface area can assume a fracture geometry (generally similar geometry as in optimum frac surface area calculation). Input parameters can include fracture width, well spacing, and other standard metrics. The standard metrics can include, but are not limited to, fracture propagation velocity, treatment volume to frac hit, frac efficiency (ratio of frac hits to clusters), and fracture azimuth.

Treatment design performance can be qualified and quantified based on frac efficiency (identified fracture count vs cluster count) and the uniformity of inverted fracture widths (e.g., Frac UE) at the monitoring well locations and/or a ratio of actual frac surface area to optimum frac surface area. Features including, but not limited to, width density and fracture density can be used to identify and delineate key drivers behind fracture growth (e.g., design variations or geologic heterogeneity). In some instances, installing a single fiber-optic cable to monitor and diagnose hydraulic fracture stimulations from multiple treatment wells may be possible. Temporary LF-DAS cross-well installations can be implemented for quantitative evaluation of completion designs and well performance. As can be appreciated, this can lead to avoiding the cost associated risks and logistical challenges of more traditional, permanent in-well fiber-optic installations.

Of note, fracking fluid often extends into unintended regions of a treatment well and surrounding formation(s). Embodiments of the present invention can include a method (or process) for providing a leakage volume estimation parameter. The leakage volume estimation parameter can utilize fracture width calculations to implement an algorithm to estimate fluid volume and distribution between targeted and unintended areas. The leakage volume estimation parameter can be a unique method for calculating a proportion of fracking fluid that can penetrate prior stages and can reactivate previously developed fractures. The leakage volume estimation parameter can implement time-dependent fracture width data derived from an inversion software and fracking fluid volume. The leakage volume estimation parameter can provide a percentage of total fluid volume that has leaked into previous stages. This information enables the assessment of fracking fluid distribution during hydraulic stimulation, where increased leakage into previous stages indicates suboptimal performance and potential mechanical issues. The leakage volume estimation parameter can provide optimization plans including identifying well construction issues and economic estimates. The leakage volume estimation parameter can be used in addition to the frac unevenness parameter and/or the ratio of actual frac surface area to the optimum frac surface area to help generate a completion design plan.

The leakage volume estimation parameter can be implemented in a fluid leak volume analysis to help identify faulty or ill-configured bridge-plug designs and evaluate cement quality and integrity in a treatment well. Economic estimates derived from the leakage volume estimation parameter can include an estimate of material cost associated with fluid and proppant delivered to an intended stage and the cost of fluid and proppant leaking back into previous sections of the well/reservoir.

In general, the leakage volume estimation parameter can be implemented to estimate a fracking fluid volume distribution across a targeted stage and unintended stage(s). A current stage can refer to a current, targeted treatment stage along the well. The current stage can be where fracking fluid is intended to be delivered and create "new" hydraulic fractures. A previous stage can refer to an adjacent stage(s) that has already been completed. Fracking fluid is not intended to be delivered in these stages. However, this often occurs and "reactivates" fractures that were created in an earlier stage.

The leakage volume estimation parameter can be defined by:

$$R = \frac{f(W_{prev})}{f(W_{cur})}$$

Where (R) can be the leakage volume estimation parameter, ($f(W_{prev})$) can link reactivated fractures from pervious stages to an injected fracking fluid volume, and ($f(W_{cur})$) can link new fractures from a current stage to the injected fracking fluid volume. The leakage volume estimation parameter can implement a ratio between a fracture width of one or more reactivated fractures in a previous completed stage and one or more new fractures created in a current stage. The leakage volume estimation parameter can provide a quantitative metric for estimating a proportion of fracking fluid delivered to previous stages. Of note, the leakage volume estimation parameter can generally be defined by a linear relationship between the fluid volume and frac-width of a previous stage and a current stage. However, it is to be appreciated that the relationship between the fluid volume and frac-width of a previous stage or a current stage may not be linear, and as such, can be a general function relating fracking fluid volume to fracture width.

Where a linear relationship is assumed, the leakage volume estimation parameter can be defined as:

$$R = \frac{W_{prev}}{W_{cur}}$$

Where (R) is the leakage volume estimation parameter, ($W_{prev}$) is a maximum cumulative fracture width of a previous stage (e.g., reactivated fractures), and ($W_{cur}$) is a maximum cumulative fracture width of a current stage (e.g., new fractures). The leakage volume estimation parameter can quantitatively define a loss of fracking fluid to a previous stage when a current stage may be treated. Of note, the leakage volume estimation parameter can be defined for each stage of the treatment well.

To help further define the leakage volume estimation parameter, one or more assumptions can be made in relation between the calculated fracture widths and fracking fluid in a previous stage and a current stage. In such an instance, the leakage volume estimation parameter (R) may be defined further as:

$$R = \frac{W_{prev}}{W_{cur}} = \frac{V_{prev}}{V_{cur} - V_{grow}}$$

Where ($V_{prev}$) is an amount of fracking fluid volume delivered to a previous stage, ($V_{cur}$) is an amount of fracking fluid volume delivered to the current stage, and (V grow) is a volume required for a fracture to reach the monitor well 112 from the treatment well 110.

The leakage volume estimation parameter (R) may be further defined as:

$$R = \frac{W_{prev}}{W_{cur}} = \frac{V_{prev}}{V_{cur} - V_{grow}} = \frac{\alpha TV}{(1-\alpha)TV - V_{grow}}$$

Where (TV) is a total fracking fluid volume for a stage and ($\alpha$) is a percentage of the total fracking fluid leaked into a previous stage. Typically, an assumption can be made that the width of reactivated fractures ($W_{prev}$) can be directly proportional to the fracking fluid volume delivered to the previous stage ($V_{prev}$). An assumption can be made that the width of new fractures ($W_{cur}$) can be proportional to the fracking fluid volume ($V_{cur}$) delivered to the current stage, with the caveat that the assumption excludes the fluid required for fracture growth ($V_{grow}$) from the treatment well to the monitor well. As can be appreciated, a creation of new fractures may require a certain volume of fluid ($V_{grow}$) for growth from the treatment well to the monitor well. However, reactivated fractures, having been formed in an earlier stage, do not need additional fluid (e.g., $V_{grow}$) for growth from the treatment well to the monitor well.

The completion design plan can include, but is not limited to, cluster spacing, perforation design, stage length, treatment pressure, proppant concentration, proppant size, fracking fluid volume, treatment program for proppant, treatment program for fracking fluid, and well spacing. Recommendations for cluster spacing can include, but is not limited to, optimizing spacing between clusters to enhance reservoir coverage and adjusting cluster spacing to achieve more uniform fracture distribution. Recommendations for perforation design can include, but is not limited to, evaluating an impact of perforation size, density, and phasing to improve performance. Recommendations for stage length can include, but is not limited to, evaluating an impact of different stage lengths on fracture development within the reservoir and an analysis can provide information to conduct economic estimates to balance the costs associated with longer/fewer stages needed to complete a well with the expected hydrocarbon recovery. Recommendations for proppant concentration and proppant size can include, but is not limited to, optimizing proppant concentrations and size to improve material cost and optimizing proppant concentrations to improve fracture development within the reservoir. Recommendations for fracking fluid volume can include, but is not limited to, optimizing fluid volume to improve material cost and adjusting fluid volumes to achieve desired fracture geometry and mitigate frac hits/well interference effects. Recommendations for well spacing can include, but is not limited to, information on fracture geometry can be utilized to improve future well placement strategies.

In one embodiment, a method to evaluate and optimize a multi-stage, multi-cluster treatment well (TW) by implementing a quantitative analysis using distributed strain data acquired at a monitoring well during hydraulic fracturing treatments of the TW can include, but is not limited to, the steps of: (i) using a fracture width calculation to determine a plurality of hydraulic fracture widths based on the distributed strain data related to hydraulic fractures created during one or more multi-cluster treatment stages of the treatment well; (ii) assessing a geometry of each of the plurality of hydraulic fracture widths; (iii) providing one or more hydraulic fracturing design recommendations in a completion design plan to (a) optimize fracture surface area contact with a reservoir, and (b) enhance access to hydrocarbon resources; and (iv) implementing at least one of the one or more hydraulic fracturing design recommendations in a future treatment well. The fracture width calculation can include, but is not limited to, the steps of: (i) processing the distributed strain data to determine one or more frac-hits for each stage of the treatment well, a frac-hit being defined as a fracture detected by the monitoring well; (ii) correlating each of the one or more frac-hits with a perforation cluster of a perforation cluster group for each stage; (iii) creating a fracture-cluster pair for each correlated frac-hit and perforation cluster of each perforation cluster group; and (iv) calculating a fracture width of each of the one or more frac-hits. The step of assessing the geometry of each of the plurality of hydraulic fracture widths can include, but is not limited to, the steps of: (i) determining a frac efficiency for each perforation cluster group, the frac efficiency being defined as a number of fractures detected by the monitoring well compared to a number of perforation clusters in each stage of the TW; and (ii) determining a frac unevenness parameter for each perforation cluster group having a frac efficiency greater than a predetermined threshold, the frac unevenness parameter implementing (a) a maximum fracture width, (b) a mean fracture width, and (c) a number of perforation clusters in the perforation cluster group.

In one instance, the method may further include the steps of: (i) determining a fracture surface area parameter for each perforation cluster group that has a frac efficiency less than the predetermined threshold, the fracture surface area parameter implementing (a) an individual maximum fracture width, (b) a cumulative maximum fracture width, (c) an optimum fracture surface area, and (d) an actual surface area; (ii) updating the completion design plan based at least in-part on the fracture surface area parameter; and (iii) implementing one or more design option parameters based on the updated completion design plan.

In some instances, the method may further include the steps of: (i) defining a leakage volume estimation parameter for each of the one or more multi-cluster treatment stages; (ii) assessing a fracking fluid loss of each of the one or more multi-cluster treatment stages based on the leakage volume estimation parameter; and (iii) updating the completion design plan based at least in-part on the assessment of fracking fluid loss. The step of defining the leakage volume estimation parameter can include, but is not limited to, the steps of: (i) calculating a cumulative maximum fracture width for each of the one or more multi-cluster treatment stages of the treatment well; (ii) defining a current stage and an associated current cumulative maximum fracture width; (iii) defining a previous stage and an associated previous cumulative maximum fracture width; and (iv) comparing the previous cumulative maximum fractured width to the current cumulative maximum fracture width.

The method may further include the steps of: (i) identifying one or more non-leakage stages of the one or more multi-cluster treatment stages; (ii) calculating a fluid volume at frac-hit arrival times for new fractures; (iii) analyzing data by applying a leakage volume algorithm related to the leakage volume estimation parameter; and (iv) assessing a fracking fluid distribution for each of the one or more multi-cluster treatment stages based on the leakage volume algorithm.

In another embodiment, a method to quantitatively analyze a multi-cluster treatment well and provide a completion design plan for a future multi-cluster treatment well can include, but is not limited to, the steps of: (i) receiving distributed strain data for each stage of the multi-cluster treatment well from a monitoring well; (ii) calculating a fracture width for each fracture created in the multi-cluster treatment well based on the distributed strain data; (iii) creating a completion design plan based on at least one of a (a) frac unevenness parameter, (b) fracture surface area parameter, and (c) leakage volume estimation parameter; and (iv) implementing one or more design option parameters for at least one stage of the future treatment well based on the completion design plan.

In yet another embodiment, a method to quantitatively analyze a multi-cluster treatment well and provide a completion design plan for a future multi-cluster treatment well can include, but is not limited to, the steps of: (i) receiving distributed strain data for each stage of the multi-cluster treatment well from a monitoring well, each stage of the multi-cluster treatment well including a perforation cluster group; (ii) processing the distributed strain data to determine one or more frac-hits for each stage of the multi-cluster treatment well, a frac-hit being defined as a fracture detected by the monitoring well; (iii) correlating each of the one or more frac-hits with a perforation cluster of the perforation cluster group for each stage; (iv) creating a fracture-cluster pair for each correlated frac-hit and perforation cluster of each perforation cluster group; (v) calculating a fracture width for each of the one or more frac-hits; (vi) determining a frac efficiency for each perforation cluster group, the frac efficiency being defined as a number of fractures detected by the monitoring well compared to a number of perforation clusters in each stage of the completed well; (vii) determining a frac unevenness parameter for each perforation cluster group having a frac efficiency greater than a predetermined threshold, the frac unevenness parameter implementing (a) a maximum fracture width, (b) a mean fracture width, and (c) a number of perforation clusters in the perforation cluster group; (viii) providing a completion design plan for the future multi-cluster treatment well based at least in-part on the frac unevenness parameter of the multi-cluster treatment well; and (ix) implementing one or more design option parameters for the future multi-cluster treatment well based on the completion design plan.

The present invention can be embodied as devices, systems, methods, and/or computer program products. Accordingly, the present invention can be embodied in hardware and/or in software (including firmware, resident software, micro-code, etc.). Furthermore, the present invention can take the form of a computer program product on a computer-usable or computer-readable storage medium having computer-usable or computer-readable program code embodied in the medium for use by or in connection with an instruction execution system. In one embodiment, the present invention can be embodied as non-transitory computer-readable media. In the context of this document, a computer-usable or computer-readable medium can include, but is not limited to, any medium that can contain, store, communicate, propagate, or transport the program for use by or in connection with the instruction execution system, apparatus, or device.

The computer-usable or computer-readable medium can be, but is not limited to, an electronic, magnetic, optical, electromagnetic, infrared, or semiconductor system, apparatus, device, or propagation medium.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

The term "software," as used in this specification and the appended claims, refers to programs, procedures, rules, instructions, and any associated documentation pertaining to the operation of a system.

The term "firmware," as used in this specification and the appended claims, refers to computer programs, procedures, rules, instructions, and any associated documentation contained permanently in a hardware device and can also be flashware.

The term "hardware," as used in this specification and the appended claims, refers to the physical, electrical, and mechanical parts of a system.

The terms "computer-usable medium" or "computer-readable medium," as used in this specification and the appended claims, refers to any medium that can contain, store, communicate, propagate, or transport the program for use by or in connection with the instruction execution system, apparatus, or device. The computer-usable or computer-readable medium may be, for example but not limited to, an electronic, magnetic, optical, electromagnetic, infrared, or semiconductor system, apparatus, device, or propagation medium. By way of example, and not limitation, computer readable media may comprise computer storage media and communication media.

The term "signal," as used in this specification and the appended claims, refers to a signal that has one or more of its characteristics set or changed in such a manner as to encode information in the signal. It is to be appreciated that wireless means of sending signals can be implemented including, but not limited to, Bluetooth, Wi-Fi, acoustic, RF, infrared and other wireless means.

An Embodiment of a Fracking Efficiency Evaluation System

Referring to FIG. 1A, a block diagram of an embodiment 100 of a fracking efficiency evaluation (FEE) system is illustrated. The FEE system 100 can be implemented to provide a completion design plan for a treatment well.

As shown in FIG. 1, the FEE system 100 can include, but is not limited to, a control module 102 and a hydraulic fracturing stimulation (HFS) system 104. The control module 102 can be implemented to receive data from the HFS system 104 and determine one or more recommendations for cluster spacing, perforation design, stage length, proppant concentration, proppant size, fracking fluid volume, and well spacing for each stage of a future treatment well based on analyzing the received data. Typically, the recommendations can be included in a completion design plan for the future treatment well. In some instances, the recommendations can be provided in near real-time to allow for adjustments to a new stage of a treatment well currently being treated.

The HFS system 104 can include, but is not limited to, a treatment well 110, a monitoring well 112, a treatment well injection system 114, and a distributed acoustic sensing (DAS) system 116. In some instances, the treatment well injection system 114 can include injection equipment that may be altered based on data of a previous stage analyzed by the control module 102. Generally, the monitoring well 112 can include the DAS system 116 for detecting fractures from the treatment well 110. The DAS system 116 can provide distributed strain data to the control module 102. In one example, the DAS system 116 can be a low-frequency distributed acoustic sensing (LF-DAS) system. It is to be appreciated that other means for obtaining distributed strain data are contemplated and not outside a scope of the present disclosure.

The treatment well injection system 114 can typically include an injection control module and injection equipment for fracturing each stage of the treatment well 110. The injection control module may communicate with the injection equipment and the control module 102. It is to be appreciated that the treatment well injection system 114 may include additional and/or different features for implementing perforation cluster spacing and stage length control. A treatment plan for the treatment well 110 may specify initial parameters for the treatment fluid to be injected into treatment well 110 for each stage. The treatment plan may include stage lengths and a number of perforation clusters for each stage of the treatment well 110. These parameters may be updated after analyzing data from the monitoring well 112 in near real-time or in a future treatment well.

The control module 102 can generally include a processor 120, random access memory 122, a nonvolatile storage (or memory) 124, and a network interface 126. The processor 120 can be a single microprocessor, multi-core processor, or a group of processors. The random-access memory 122 can store executable code as well as data that may be immediately accessible to the processor 120, while the nonvolatile storage 124 can store executable code and data in a persistent state. The network interface 126 can include hardwired and wireless interfaces through which the control module 102 can communicate with other devices and/or networks. In some embodiments, more than one control module 102 can be implemented. The control module 102 can be configured to perform one or more steps of the methods described hereinafter.

Typically, the control module 102 can be any type of computing device including, but not limited to, a personal computer, a server, a programmable logic controller, a game console, a smartphone, a tablet, a netbook computer, or other computing devices. In one embodiment, the control module 102 can be a distributed system wherein computing functions are distributed over several computers connected to a network. The control module 102 can typically have a hardware platform and software components.

Figure 1B:
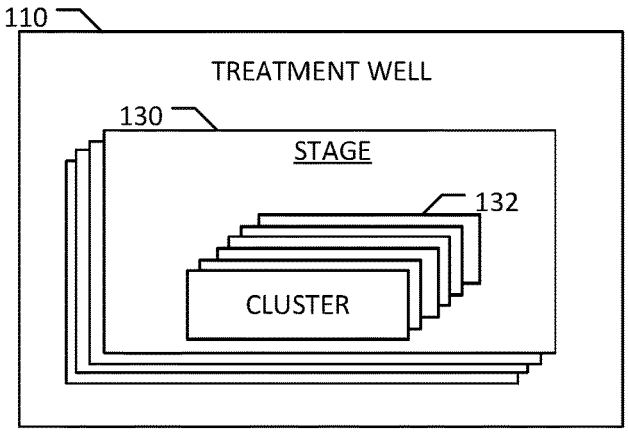
FIG. 1B is a block diagram of a treatment well according to one embodiment of the present invention.

Referring to FIG. 1B, a block diagram of the treatment well 110 is shown. In general, the treatment well 110 can include a plurality of stages 130 that each include a plurality of clusters 132. The plurality of clusters 132 can include perforations allowing for fracking fluid to engage a surrounding area.

Figure 2:
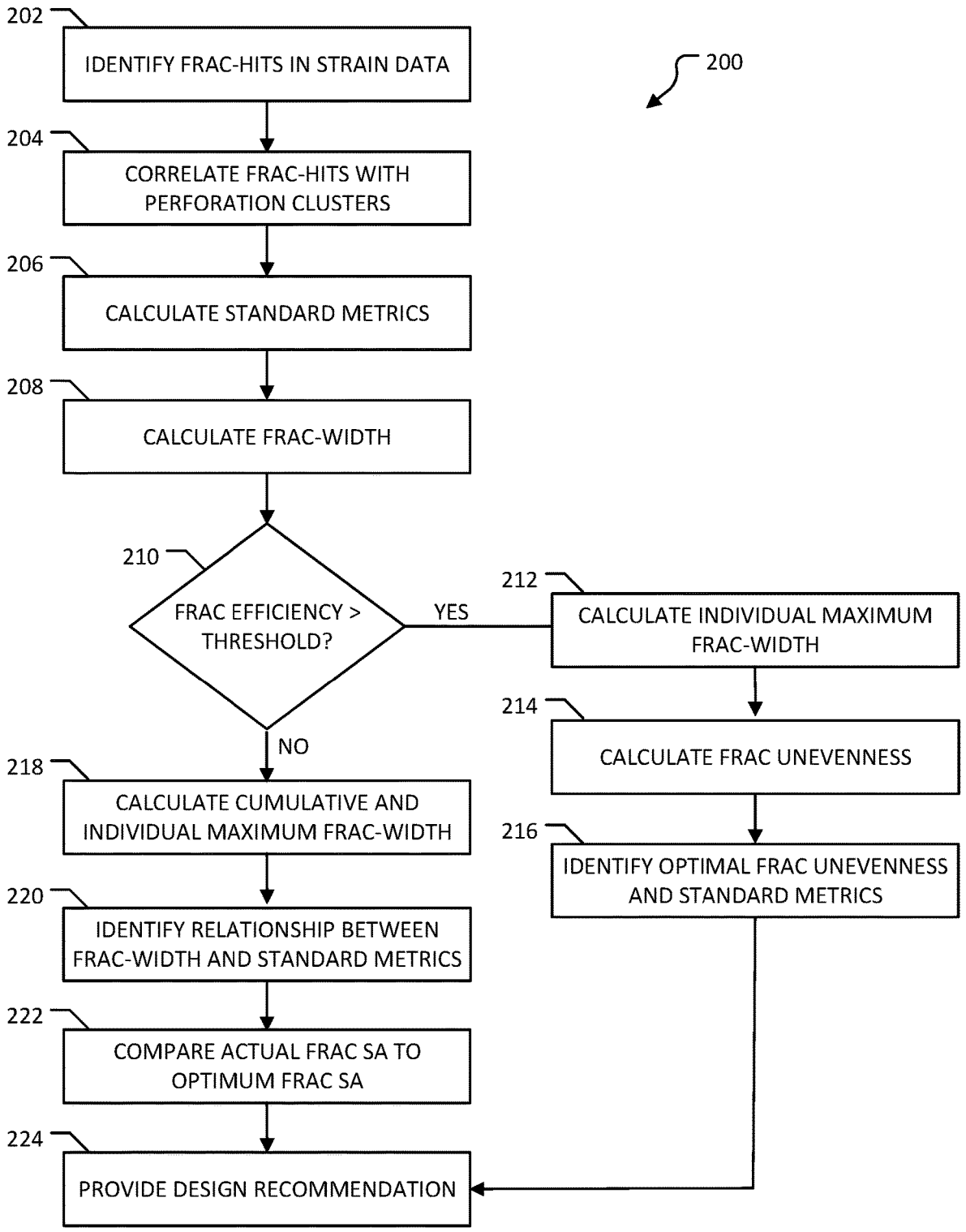
FIG. 2 is a flow diagram of a method for generating a completion design plan according to one embodiment of the present invention.

Referring to FIG. 2, a flow diagram of one example method (or process) 200 of generating a completion design plan for a future treatment well is illustrated. Typically, the method 200 can be repeated for each stage of the treatment well 110. Once each stage has been completed and analyzed via the method 200, the completion design plan can be generated.

In some instances, the method 200 can be implemented in near real-time while a treatment well is being treated. For instance, the DAS system 116 can be implemented to monitor a treatment well currently being treated. After each stage of the treatment well has been completed, data related to the completed stage can be provided to the control module 102. In most instances, the data can be analyzed to determine strain along a length of a fiber optic cable to generate distributed strain data prior to the data being sent to the control module 102. The control module 102 can be configured to analyze the distributed strain data from the DAS system 116. In some embodiments, the control module 102 may be configured to analyze data directly from the DAS system 116 to determine strain along a length of the fiber optic cable and generate the distributed strain data. Of note, the completion design plan may be continuously updated and may allow for a currently treated well to be optimized based on one or more previously completed stages.

Embodiments are contemplated where the completion design plan may not be generated until a treatment well is completed. In such an embodiment, the completion design plan may be implemented for a future treatment well. Once the distributed strain data from the completed treatment well is generated, the data can be sent to the control module 102. The method 200 can be implemented to analyze each stage of the completed treatment well. As can be appreciated, the data for each stage of the completed treatment well may be analyzed to help determine a completion design plan to be implemented for a future well. Each stage of the completed treatment well can be analyzed via the method 200 and can be used to generate the completion design plan.

In block 202, fracture hits (or frac-hits) can be identified in the analyzed strain data received from the monitoring well 112.

In block 204, identified frac-hits can be correlated with perforation clusters from each stage of the treatment well 110.

In block 206, standard metrics related to the strain data can be calculated. The standard metrics can be used in future steps of the method 200 to help prepare the completion design plan.

In block 208, a fracture width (or frac-width) of each frac-hit can be calculated. Each calculated frac-width can be associated with a stage where the fracture was created in the treatment well 110.

In decision block 210, a determination can be made if a frac efficiency of a cluster group from a stage is greater than a predetermined threshold. Frac efficiency can be defined as a ratio of a number of fractures detected at the monitoring well 112 to the number of clusters in a treatment stage. The frac efficiency can be determined for each stage of the treatment well 110. As can be appreciated, a frac efficiency for each stage can be calculated and a determination can be made for each stage if the associated frac efficiency is greater than the predetermined threshold. In one instance, the predetermined threshold can be between approximately 40% to 60%. If the frac efficiency is greater than the threshold, the method 200 can move to block 212. If the frac efficiency is less than the threshold, the method 200 can move to block 218.

In block 212, an individual maximum frac-width can be calculated for each frac-hit.

In block 214, a fracture unevenness (Frac UE) parameter can be calculated. The Frac UE parameter can be a novel parameter used in generating the completion design plan. Fracture-cluster pairs can be assigned based on a relative spacing between perforation clusters in the treatment well 110 and individual fractures detected (frac-hits) at the monitoring well 112. As previously mentioned, the Frac UE parameter can be defined as:

$$Frac\ UE = 100 * \left( \frac{\sqrt{\frac{\sum_{i=1}^{n} (x_i - \bar{x})^2}{n-1}}}{\frac{\sum_{i=1}^{n} x_i}{n}} \right)$$

Where "$x_i$" is the maximum fracture width associated with each fracture-cluster pair, "$\bar{x}$" is the mean fracture width for the stage, and "n" is the number of clusters in the stage. If a cluster does not result in an identified fracture hit at the monitoring well, that fracture may be assigned a width value of zero.

In block 216, an optimal frac unevenness can be identified from each stage of the treatment well and standard metrics can be associated with each stage in addition to the frac unevenness parameter. As previously described, only stages that had a frac efficiency greater than the predetermined threshold can be analyzed with the frac UE parameter. The method 200 may then move to block 224.

For stages where the frac efficiency was lower than the predetermined threshold, the method can move to block 218 instead of previously described blocks 212-216. In block 218, an individual maximum frac-width and a cumulative maximum frac-width can be calculated for each stage where the frac efficiency was below the threshold.

In block 220, a relationship between frac-width and standard metrics can be identified.

In block 222, a ratio of actual frac surface area to optimum frac surface area may be implemented to create a fracture surface area parameter. The fracture surface area parameter can be a ratio between an actual frac surface area and an optimum frac surface area. More specifically, a ratio can be calculated of actual frac surface area to optimum frac surface area to generate a percentage value that can be used for design optimization decisions in the completion design plan. The optimum frac surface area can assume a fracture geometry and that all clusters at the treatment well initiate a fracture that grows within the assumed fracture geometry. The fracture geometry parameters can be constrained by treatment fluid volume. The fracture geometry parameters can include, but are not limited to, fracture width, length, and height. The actual frac surface area can assume a fracture geometry (generally similar geometry as optimum frac surface area). Input parameters can include fracture width, well spacing, and other standard metrics. The standard metrics can include, but are not limited to, propagation velocity, treatment volume to frac hit, frac efficiency (ratio of frac hits to clusters), and fracture azimuth.

In block 224, a completion design plan (or recommendation) can be provided to a user. The completion design plan can include, but is not limited to, recommendations for cluster spacing, perforation design, stage length, proppant concentration, proppant size, fracking fluid volume, and well spacing. The completion design plan can implement all of the data from the monitoring well 112 for each stage to determine which stages were most effective. It is to be appreciated that the completion design plan may consider a preference of a user when finalizing the completion design plan. For instance, a user may prefer cost saving over efficiency.

Figure 3:
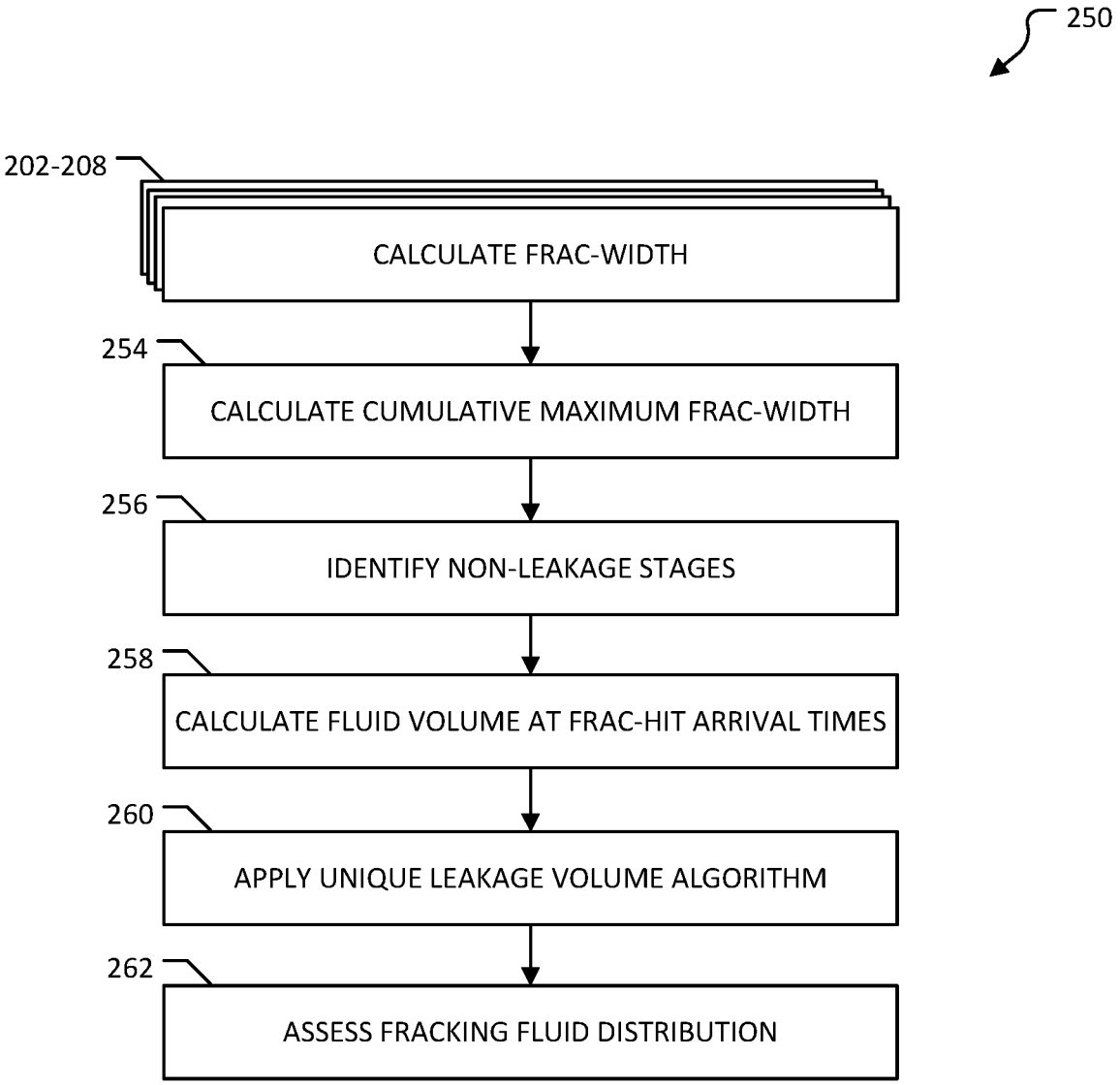
FIG. 3 is a flow diagram of a method for determining a leakage volume estimation parameter according to one embodiment of the present invention.

Referring to FIG. 3, a flow diagram of one example method (or process) 250 of analyzing fluid distribution in a treatment well is illustrated. Generally, the method 250 can be implemented in addition to the method 200 for generating a completion design plan and provide one or more recommendations related to fluid distribution for optimizing a completion of a future treatment well. The method 250 can be implemented to generate a leakage volume estimation parameter. The leakage volume estimation parameter can utilize fracture width calculations in an algorithm to estimate fluid volume and distribution between targeted and unintended areas (e.g., previously completed stages). Typically, the leakage volume estimation parameter can be used in addition to the frac unevenness (Frac UE) parameter to help generate a completion design plan.

Of significant note, the leakage volume estimation parameter can implement calculated fractured widths from data of the monitoring well 112 created by the treatment well 110 to estimate an amount of leaked (or wasted) fracking fluid in each stage of the treatment well 110. Generally, when completing a stage, fracking fluid may leak into a previously completed stage. When analyzing the treatment well 110, the process 250 may be implemented to provide a leakage volume estimation parameter for each stage to help in generating the completion design plan for a future treatment well.

The method 250 can include the previously described steps in blocks 202-208 of the method 200. As shown and previously described, in block 208, a fracture width can be calculated for each frac hit.

In block 254, a cumulative maximum fracture width can be calculated for each fracture-cluster pair. In general, assessing the cumulative maximum fracture width involves two components $W_{cur}$ and $W_{prev}$. As previously mentioned, $W_{cur}$ can be a width of new fractures in a current stage being treated and $W_{prev}$ can be a width of reactivated fractures (e.g., previously created fractures) from previous adjacent stage(s). Of note, $W_{cur}$ represents the width of newly induced fractures in the target stage and $W_{prev}$ can account for reactivated fractures from preceding stages.

In block 256, each non-leakage stage of the treatment well can be identified. Non-leakage stages can be characterized by an absence of reactivated fractures. In one instance, this can be seen in stages where only the presence of newly induced fractures in the current stage are observed.

In block 258, a fluid volume can be calculated at a frac-hit arrival time. Determining an average arrival volume of fractures during a non-leakage stage enables an empirical estimation of the component $V_{grow}$. $V_{grow}$ can represent a fluid volume required for an initiation of new fractures at a cluster group of a stage of the treatment well 110 and their subsequent propagation to the monitor well 112. Arrival volume may specifically refer to a quantity of total fracking fluid injected at the moment a fracture reaches the monitoring well 112.

In block 260, the fluid volume and plurality of hydraulic fracture widths can be analyzed to determine a fracking fluid distribution by applying a leakage volume algorithm related to the leakage volume estimation parameter. The leakage volume algorithm can be implemented to evaluate a percentage ($\alpha$) of fracking fluid volume delivered to previous stages via reactivated fractures. As shown in the equation below, the fracture width data in addition to the fluid volume data can be used to solve for the percentage ($\alpha$) of fracking fluid volume delivered to previous stages via reactivated fractures.

$$R = \frac{W_{prev}}{W_{cur}} = \frac{V_{prev}}{V_{cur} - V_{grow}} = \frac{\alpha TV}{(1-\alpha)TV - V_{grow}}$$

In block 262, a fracking fluid distribution can be assessed based on the unique leakage volume algorithm. The fracking fluid distribution can be assessed for each stage of the treatment well using the leakage volume estimation parameter. In general, the fracking fluid distribution can be used to determine how much fluid leaked into a previous stage.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

We claim:

1. A method to evaluate at least one stage of a multi-stage, multi-cluster hydraulic fracturing treatment well (TW) by implementing a quantitative analysis using distributed strain data acquired at a monitoring well during fracturing treatments of the TW, the method comprising:

using a fracture width calculation to determine a plurality of hydraulic fracture widths based on the distributed strain data related to hydraulic fractures created during one or more multi-cluster treatment stages of the TW;

assessing a geometry of each of the plurality of hydraulic fracture widths;

providing one or more hydraulic fracturing design recommendations in a completion design plan to (i) optimize fracture surface area contact with a reservoir, and (ii) enhance access to hydrocarbon resources; and implementing at least one of the one or more hydraulic fracturing design recommendations in a future treatment well.

2. The method of claim 1, wherein the fracture width calculation includes the steps of:

processing the distributed strain data to determine one or more frac-hits for each stage of the TW, a frac-hit being defined as a fracture detected by the monitoring well;

correlating each of the one or more frac-hits with a perforation cluster of a perforation cluster group for each stage;

creating a fracture-cluster pair for each correlated frac-hit and perforation cluster of each perforation cluster group; and calculating a fracture width of each of the one or more frac-hits.

3. The method of claim 2, wherein the step of assessing the geometry of each of the plurality of hydraulic fracture widths includes the steps of:

determining a frac efficiency for each perforation cluster group, the frac efficiency being defined as a number of fractures detected by the monitoring well compared to a number of perforation clusters in each stage of the TW; and determining a frac unevenness parameter for each perforation cluster group having a frac efficiency greater than a predetermined threshold, the frac unevenness parameter implementing (i) a maximum fracture width, (ii) a mean fracture width, and (iii) a number of perforation clusters in the perforation cluster group.

4. The method of claim 3, further including the steps of:

determining a fracture surface area parameter for each perforation cluster group that has a frac efficiency less than the predetermined threshold, the fracture surface area parameter implementing (i) an individual maximum fracture width, (ii) a cumulative maximum fracture width, (iii) an optimum fracture surface area, and (iv) an actual surface area;

updating the completion design plan based at least in-part on the fracture surface area parameter; and implementing one or more design option parameters based on the updated completion design plan.

5. The method of claim 1, further including the steps of:

defining a leakage volume estimation parameter for each of the one or more multi-cluster treatment stages;

assessing a fracking fluid loss of each of the one or more multi-cluster treatment stages based on the leakage volume estimation parameter; and updating the completion design plan based at least in-part on the assessment of fracking fluid loss.

6. The method of claim 5, wherein the step of defining the leakage volume estimation parameter includes the steps of:

calculating a cumulative maximum fracture width for each of the one or more multi-cluster treatment stages of the TW;

defining a current stage and an associated current cumulative maximum fracture width;

defining a previous stage and an associated previous cumulative maximum fracture width; and comparing the previous cumulative maximum fracture width to the current cumulative maximum fracture width.

7. The method of claim 6, further including the steps of:

identifying one or more non-leakage stages of the one or more multi-cluster treatment stages;

calculating a fluid volume at frac-hit arrival times for new fractures;

analyzing the fluid volume and plurality of hydraulic fracture widths to determine a fracking fluid distribution by applying a leakage volume algorithm related to the leakage volume estimation parameter; and assessing the fracking fluid distribution between a current stage and leakage into a previous stage for each of the one or more multi-cluster treatment stages based on the leakage volume algorithm.

8. The method of claim 1, wherein the completion design plan includes recommendations for cluster spacing, perforation design, stage length, treatment pressure, proppant concentration, proppant size, fracking fluid volume, treatment program for proppant, treatment program for fracking fluid, and well spacing.

9. The method of claim 1, wherein the plurality of hydraulic fracture widths are used to quantitatively generate (i) a frac unevenness parameter, (ii) a fracture surface area parameter, and (iii) a leakage volume estimation parameter.

10. The method of claim 9, further including the step of:

updating the completion design plan based at least in-part on one of the frac unevenness parameter, the fracture surface area parameter, and the leakage volume estimation parameter.

11. A method to quantitatively analyze a multi-cluster treatment well and provide a completion design plan for a future multi-cluster treatment well, the method comprising:

receiving distributed strain data for each stage of the multi-cluster treatment well from a monitoring well;

calculating a fracture width for each fracture created in the multi-cluster treatment well based on the distributed strain data;

creating a completion design plan based on at least one of a (i) frac unevenness parameter, (ii) fracture surface area parameter, and (iii) leakage volume estimation parameter; and implementing one or more design option parameters for at least one stage of the future treatment well based on the completion design plan.

12. The method of claim 11, wherein the step of calculating a fracture width includes:

processing the distributed strain data to determine one or more frac-hits for each stage of the multi-cluster treatment well, a frac-hit being defined as a fracture detected by the monitoring well;

correlating each of the one or more frac-hits with a perforation cluster of a perforation cluster group for each stage;

creating a fracture-cluster pair for each correlated frac-hit and perforation cluster of each perforation cluster group; and calculating a fracture width of each of the one or more frac-hits.

13. The method of claim 11, wherein the frac unevenness parameter is defined by (i) a maximum fracture width, (ii) a mean fracture width, and (iii) a number of perforation clusters in a perforation cluster group for each stage of the multi-cluster treatment well.

14. The method of claim 11, wherein the leakage volume estimation parameter is defined by (i) calculating a cumulative maximum fracture width for each stage of the multi-cluster treatment well, (ii) defining a current stage and an associated current cumulative maximum fracture width, (iii) defining a previous stage and an associated previous cumulative maximum fracture width, and (iv) comparing the previous cumulative maximum fracture width to the current cumulative maximum fracture width.

15. The method of claim 11, wherein the fracture surface area parameter is defined for each stage of the multi-cluster treatment well by (i) an individual maximum fracture width, (ii) a cumulative maximum fracture width, (iii) an optimum fracture surface area, and (iv) an actual surface area.

16. The method of claim 11, wherein the one or more design option parameters are selected from the group consisting of cluster spacing, perforation design, stage length, treatment pressure, proppant concentration, proppant size, fracking fluid volume, treatment program for proppant, treatment program for fracking fluid, and well spacing.

17. A method to quantitatively analyze a multi-cluster treatment well and provide a completion design plan for a future multi-cluster treatment well, the method comprising:

receiving distributed strain data for each stage of the multi-cluster treatment well from a monitoring well, each stage of the multi-cluster treatment well including a perforation cluster group;

processing the distributed strain data to determine one or more frac-hits for each stage of the multi-cluster treatment well, a frac-hit being defined as a fracture detected by the monitoring well;

correlating each of the one or more frac-hits with a perforation cluster of the perforation cluster group for each stage;

creating a fracture-cluster pair for each correlated frac-hit and perforation cluster of each perforation cluster group;

calculating a fracture width for each of the one or more frac-hits;

determining a frac efficiency for each perforation cluster group, the frac efficiency being defined as a number of fractures detected by the monitoring well compared to a number of perforation clusters in each stage of the completed well;

determining a frac unevenness parameter for each perforation cluster group having a frac efficiency greater than a predetermined threshold, the frac unevenness parameter implementing (i) a maximum fracture width, (ii) a mean fracture width, and (iii) a number of perforation clusters in the perforation cluster group;

providing a completion design plan for the future multi-cluster treatment well based at least in-part on the frac unevenness parameter of the multi-cluster treatment well; and implementing one or more design option parameters for the future multi-cluster treatment well based on the completion design plan.

18. The method of claim 17, further including the steps of:

determining a fracture surface area parameter for each perforation cluster group that has a frac efficiency less than the predetermined threshold, the fracture surface area parameter being determined for each stage by implementing (i) an individual maximum fracture width, (ii) a cumulative maximum fracture width, (iii) an optimum fracture surface area, and (iv) an actual surface area;

updating the completion design plan based at least in-part on the fracture surface area parameter; and implementing one or more design option parameters based on the updated completion design plan.

19. The method of claim 17, further including the steps of:

defining a leakage volume estimation parameter for each stage of the multi-cluster treatment well including the steps of:

calculating a cumulative maximum fracture width for each stage of the multi-cluster treatment well;

identifying one or more non-leakage stages;

calculating a fluid volume at frac-hit arrival times for new fractures in the non-leakage stages;

analyzing the fluid volume and the fracture widths of each frac-hit to determine a fracking fluid distribution by applying a leakage volume algorithm related to the leakage volume estimation parameter; and assessing the fracking fluid distribution of each stage of the multi-cluster treatment well based on the leakage volume estimation parameter.

20. The method of claim 19, wherein one or more of the design option parameters of the completion design plan are updated based on the fracking fluid distribution.

* * * * *